US011495889B2

(12) United States Patent
Baek et al.

(10) Patent No.: US 11,495,889 B2
(45) Date of Patent: Nov. 8, 2022

(54) METHOD OF CONTROLLING DIELECTRIC CONSTANT OF COMPOSITE MATERIAL BY MICRO PATTERN PRINTING

(71) Applicant: AGENCY FOR DEFENSE DEVELOPMENT, Daejeon (KR)

(72) Inventors: Sangmin Baek, Daejeon (KR); Wonjun Lee, Daejeon (KR); Sangyong Kim, Daejeon (KR); Jeongin Go, Daejeon (KR)

(73) Assignee: AGENCY FOR DEFENSE DEVELOPMENT, Daejeon (KR)

( * ) Notice: Subject to any disclaimer, the term of this patent is extended or adjusted under 35 U.S.C. 154(b) by 286 days.

(21) Appl. No.: 16/741,304

(22) Filed: Jan. 13, 2020

(65) Prior Publication Data

US 2020/0280137 A1 Sep. 3, 2020

(30) Foreign Application Priority Data

Jan. 25, 2019 (KR) ..... 10-2019-0009889

(51) Int. Cl.
*H01Q 17/00* (2006.01)

(52) U.S. Cl.
CPC ..... *H01Q 17/007* (2013.01)

(58) Field of Classification Search
CPC ..... H01Q 17/007
USPC ..... 342/4, 368; 343/872
See application file for complete search history.

(56) References Cited

U.S. PATENT DOCUMENTS

2010/0039346 A1* 2/2010 Peter ..... H01Q 1/421 342/368

FOREIGN PATENT DOCUMENTS

| | | | |
|---|---|---|---|
| KR | 10-2009-0072077 | A | 7/2009 |
| KR | 10-2012-0085955 | A | 8/2012 |
| KR | 10-2013-0023104 | A | 3/2013 |
| KR | 10-2015-0045393 | A | 4/2015 |
| KR | 10-2017-0077369 | A | 7/2017 |
| KR | 10-1772088 | B1 | 8/2017 |
| KR | 10-1901094 | B1 | 9/2018 |

OTHER PUBLICATIONS

Petition for Accelerated Examination dated Jan. 28, 2019 in corresponding Korean Patent Application No. 10-2019-0009889.
Decision on Accelerated Examination dated Feb. 7, 2019 in corresponding Korean Patent Application No. 10-2019-0009889.
Office Action dated Mar. 12, 2019 in corresponding Korean Patent Application No. 10-2019-0009889.
Applicant's Search Report dated Dec. 14, 2018.
Notice of Allowance dated Jun. 18, 2019 in corresponding Korean Patent Application No. 10-2019-0009889.

* cited by examiner

*Primary Examiner* — Bo Fan
(74) *Attorney, Agent, or Firm* — Ostrolenk Faber LLP

(57) ABSTRACT

A method for controlling dielectric constant of a composite material through micro pattern printing includes setting a dielectric constant value needed in the composite material, preparing a paste having an electromagnetic loss material, fabricating a composite material sheet by forming the paste on one surface of a base member in a predetermined pattern, and fabricating the composite material sheet with the micro patterns including the electromagnetic loss material on the base member by drying the composite material sheet, wherein the base member is formed of a sheet and includes fibers.

13 Claims, 14 Drawing Sheets

$$Z=\sqrt{\frac{\mu}{\varepsilon}} \quad \text{Impedance}$$

$$\tau=\frac{E_t}{E_i}=\frac{2Z_2}{Z_1+Z_2} \quad \text{Transmission coefficient}$$

$$\rho=\frac{E_r}{E_i}=\frac{Z_2-Z_1}{Z_2+Z_1} \quad \text{Reflection coefficient}$$

$$Z=\sqrt{\frac{\mu}{\varepsilon}}$$ Impedance $$\tau=\frac{E_t}{E_i}=\frac{2Z_2}{Z_1+Z_2}$$ Transmission coefficient $$\rho=\frac{E_r}{E_i}=\frac{Z_2-Z_1}{Z_2+Z_1}$$ Reflection coefficient

METHOD OF CONTROLLING DIELECTRIC CONSTANT OF COMPOSITE MATERIAL BY MICRO PATTERN PRINTING

CROSS-REFERENCE TO RELATED APPLICATION

Pursuant to 35 U.S.C. § 119(a), this application claims the benefit of the earlier filing date and the right of priority to Korean Patent Application No. 10-2019-0009889, filed on Jan. 25, 2019, the contents of which is incorporated by reference herein in its entirety.

BACKGROUND

1. Technical Field

The present disclosure relates to a method for controlling dielectric constant of a composite material having a radar absorbing structure.

2. Description of the Related Art

In a development of weapon systems, demands for stealth continue to increase. Stealth technology may be divided into a method for scattering morphologically incident radar signals into non-hazardous areas to minimize an exposure of signals to a detection network of an enemy, and a method for applying a radar absorbing material (RAM) or a radar absorbing structure (RAS) to scatter signals as a heat energy, etc. inside a material. Materials such as metals (iron, aluminum alloys, etc.) or carbon fiber reinforced plastics (CFRP), which are widely used in modern aircraft weapon structures, have properties of total reflecting of incident electromagnetic waves, thereby it is difficult to give an additional radar absorbing function in addition to a shape stealth.

Accordingly, various types of radar absorbing structures have been researched and developed by combining materials having electromagnetic properties. However, upon merely combining the existing materials, design freedom is drastically lowered in setting an electromagnetic absorption frequency band, a structural property (strength/rigidity), and the like. In order to cope with a diversified threat of radar detection in battlefield, materials with electromagnetic properties suitable for a designed radio absorbing structure must be supplied.

However, a fabricating process of a composite material having an electromagnetic property studied in the related art is complicated and a precise control of the electromagnetic property is difficult. In addition, it is difficult to implement different electromagnetic properties in one composite material with the related art technologies. Therefore, structural breakage occurs when several electromagnetic materials are applied, which may cause problems in terms of structural strength.

In detail, two representative ones of the related art methods to implement an electromagnetic property of a composite material may be exemplified. A CNT impregnation method or a fiber metal coating method may implement the electromagnetic property of the composite material.

The CNT impregnation method is to fabricate prepreg by scattering and impregnating CNT in a resin of a composite material to impregnate the CNT-impregnated resin into fibers. The CNT impregnation method has a disadvantage in that viscosity of the resin is increased when impregnating the CNT in the resin, which leads to a drastic decrease in fabrication efficiency.

In addition, the fiber metal coating is a method for electroless plating/coating conductive particles on a fiber. Since the fiber metal coating requires surface treatment/chemical treatment to coat conductive particles, the surface treatment/chemical treatment affects the fiber, which reduces strength/rigidity of the composite material. The present disclosure has an advantage of overcoming those two drawbacks.

Thus, the present disclosure provides a method for controlling dielectric constant of a composite material having an improved fabrication suitable for a designed radio absorbing structure and having improved structural stiffness/strength by eliminating additional surface treatment/chemical treatment on the composite material.

SUMMARY

One aspect of the present disclosure is to provide a method for controlling dielectric constant of a composite material having improved design freedom.

Another aspect of the present disclosure is to provide a method for controlling dielectric constant of a composite material having improved dielectric constant by printing a pattern having improved conductivity.

Still another aspect of the present disclosure is to provide a method for controlling dielectric constant of a composite material having improved structural rigidity/strength by eliminating additional surface treatment/chemical treatment on the composite material.

To achieve the aspects and other advantages of the present disclosure, there is provided a method for controlling dielectric constant of composite material by micro pattern printing, including setting an electromagnetic property needed by the composite material, preparing a paste having an electromagnetic loss material, fabricating a composite material sheet by forming the paste on one surface of a base member in a predetermined pattern, and fabricating the composite material sheet with the micro patterns including the electromagnetic loss material on the base member by drying the composite material sheet, wherein the base member is formed of a sheet and includes fibers.

In one embodiment, an electromagnetic loss material includes at least one of a dielectric body, a magnetic body, or a conductor body.

In one embodiment, a paste includes thermosetting polymers and is formed into micro patterns by being thermally cured during the drying.

In one embodiment, a base member is made of at least one of glass, aramid, ceramic fiber or foam core.

In one embodiment, a base member is a fabric.

In one embodiment, a physical property is controlled by structuring a plurality of composite material sheets with micro patterns in a stacking manner.

In one embodiment, a material to control dielectric constant is further included between the composite material sheets with micro patterns.

In one embodiment, forming a prepreg by impregnating a resin into the structured composite material sheet is further included.

In one embodiment, forming a prepreg by impregnating a resin into the composite material sheet with the micro pattern is further included.

In one embodiment, the predetermined pattern formed of the paste on the one surface of the base member has a pattern gradient due to a different size of the pattern for each section of the base member.

In one embodiment, the predetermined pattern formed of the paste on the one surface of the base member may be formed of at least one type of paste.

In one embodiment, fabricating of the composite material sheet with the micro patterns is configured such that the drying of the composite material sheet is carried out for 30 to 60 minutes in a temperature range of 150 to 180° C.

In addition, the present disclosure discloses a dielectric constant-controlled composite material including a composite material sheet with micro patterns fabricated by the method for controlling the dielectric constant of the composite material of any one of claims 1 to 12.

DETAILED DESCRIPTION OF THE PREFERRED EMBODIMENT

Figure 1:
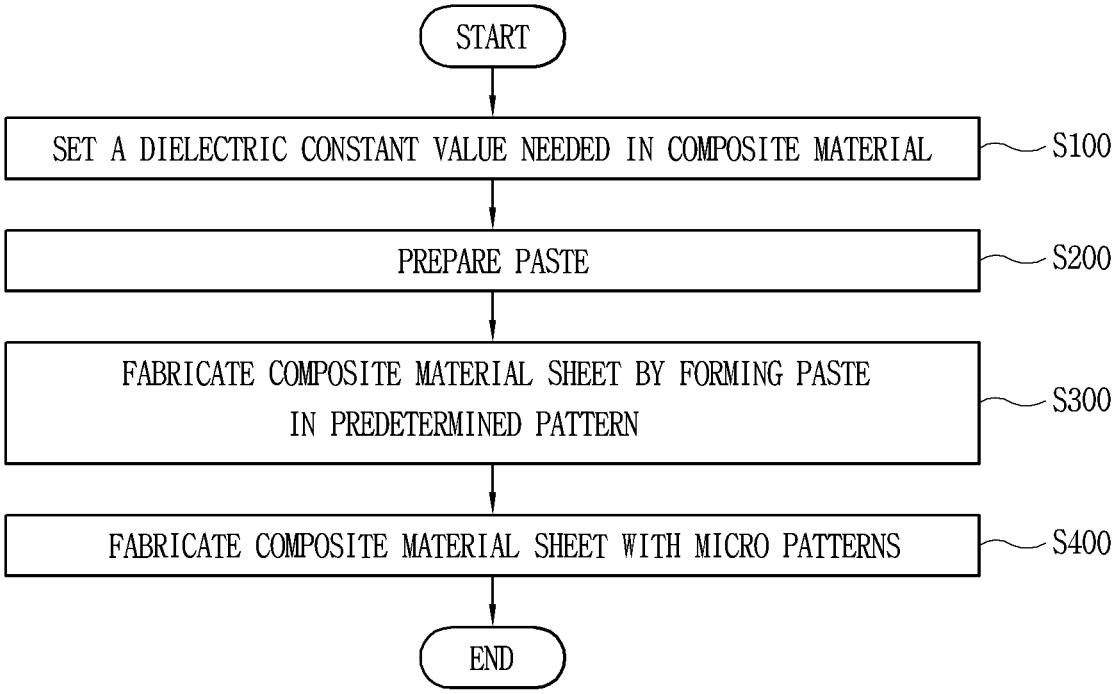
FIG. 1 is a flowchart illustrating a procedure of a method for controlling dielectric constant of a composite material through micro pattern printing, which is an embodiment of the present disclosure.

It is noted that the technical terms used herein are used only to describe specific embodiments and are not intended to limit the disclosure. In addition, a singular representation may include a plural representation unless it represents a definitely different meaning from the context. In this specification, the terms "comprising" and "including" should not be construed to necessarily include all of the elements or steps disclosed herein, and should be construed not to include some of the elements or steps thereof, or should be construed to further include additional elements or steps.

In describing the present disclosure, when a detailed explanation for a related known function or construction is considered to unnecessarily divert the gist of the present disclosure, such explanation has been omitted but would be understood by those skilled in the art.

Also, unless otherwise defined, all terms used herein, including technical or scientific terms, have the same meaning as commonly understood by one of ordinary skill in the art to which present disclosure belongs.

A method for controlling dielectric constant of a composite material through micro pattern printing of the present disclosure can be applied to a stealth technology of a weapon system in a manner of applying a radar absorbing material (RAM) or a radar absorbing structure (RAS) to scatter radar signals as a heat energy, etc. inside a material.

Since the radar absorbing structure through the method for controlling dielectric constant of composite material by micro pattern printing of the present disclosure is a multi-functional structure that simultaneously performs a function of radar absorption and a function of load support, it is important to find a design point to satisfy both functions. However, finding a design that satisfies multiple requirements with existing material combinations is difficult, and types that can be fabricated are limited. Therefore, when the technique of the present disclosure is applied, a material suitable for an optimized design of the radar absorbing structure can be supplied.

For example, when designing the radar absorbing structure in the related art technology, since structural design variables such as a thickness depend on electromagnetic design variables, a design efficiency may be lowered for mutual satisfaction of requirements of the two design parts (areas).

However, when the present technology is applied, it is possible to have different electromagnetic properties even in a composite material structure having the same structural strength/rigidity. This is a differentiated technology capable of controlling only electromagnetic properties without changing structural properties, and has an advantage of independently controlling the variables of the two design areas.

This means that the structure designed by the method for controlling dielectric constant of the composite material through micro pattern printing of the present disclosure can provide a very high design freedom. In addition, since the present disclosure does not apply a separate surface treatment/chemical treatment to a fiber which is a main load transfer path of the composite material, an effect on the structural rigidity/strength is minimal.

FIG. 1 is a flowchart illustrating a procedure of a method for controlling dielectric constant of a composite material through micro pattern printing, which is an embodiment of the present disclosure.

Referring to FIG. 1, the method for controlling dielectric constant of composite material by micro pattern printing may include setting a dielectric constant value needed in the composite material (S100), preparing a paste having an electromagnetic loss material (S200), fabricating a composite material sheet by forming the paste on one surface of a base member in a predetermined pattern (S300), and fabricating the composite material sheet with the micro patterns including the electromagnetic loss material on the base member by drying the composite material sheet (S400).

In setting a dielectric constant value needed in composite material (S100), requirements of an object that the radar absorbing structure (RAS) is applied to is analyzed by calculated electromagnetic properties of a material to perform an appropriate RAS design. The dielectric constant value is a parameter of one of electromagnetic properties, and in the present disclosure, not only dielectric constant but also magnetic permeability or conductivity value may be controlled. In one embodiment, elements needed in the RAS design to control the dielectric constant of the electromagnetic properties of the composite material are the electromagnetic properties and the size of the pattern that includes the electromagnetic loss material to be placed on the base member.

In detail, the higher the conductivity of the pattern including the electromagnetic loss material disposed on the base member is, the higher the dielectric constant of the composite material can be expected. In addition, when the conductivities of the patterns are the same, the greater the size of the pattern is, the higher the dielectric constant of the composite material can be expected. In the RAS design, the size of the pattern is preferably smaller than a wavelength of the corresponding frequency.

In preparing a paste having an electromagnetic loss material (S200), a paste to form a pattern on a base member can be fabricated. In the present disclosure, a material to form a pattern on the base member is referred to as a paste, which is not limited to a semi-solid material but may include a material state such as ink. The paste in the present disclosure may include all of the material in a liquid or semi-solid state that can form a pattern on the base member.

The paste may include an electromagnetic loss material, a functional powder, a polymer, and a solvent. In detail, the conductivity of the pattern formed of the paste may be controlled by controlling contents of the electromagnetic loss material, the functional powder, the polymer, and the solvent. In addition, depending on the components of the functional powder contained in the paste, not only electrical properties but also magnetic properties may be imparted. The method to produce the paste in detail may be described in FIG. 2 below.

In fabricating a composite material sheet by forming the paste on one surface of the base member in a predetermined pattern (S300), the paste may be printed within a unit cell size to form a predetermined pattern. In general, the electromagnetic properties can be adjusted according to an amount of the paste printed, which is closely related to controlling dielectric constant of the composite material. In the method for controlling the dielectric constant of the composite material by printing the predetermined pattern, a spacing between the patterns and a width of the pattern may be important design factors, which may be designed in setting a dielectric constant value needed in a composite material (S100) described above.

The base member may be formed of a low dielectric loss composite material. Specifically, the base member is formed of a sheet and may include fibers. Furthermore, the fibers included in the base member may be made of at least one of glass, aramid, ceramic fiber or foam core. In addition, the aforementioned reinforcing fibers, except for carbon-based fibers, may be used for the base member. This is because carbon-based fibers have very high conductivity themselves and reflect radars, which makes it difficult to increase the dielectric constant of the composite material. Further, the base member may be a fabric including fibers. As a result, a pattern formed by using a paste on the base member can be formed evenly.

In drying the composite material sheet to fabricate the composite material sheet formed with micro patterns including the electromagnetic loss material on the base member (S400), a composite material sheet having micro patterns including the electromagnetic loss material on the base member is fabricated.

Micro patterns formed on the base member by the drying process can be maintained without deformation of the shape. In one embodiment, conditions of the drying process may be carried out in a temperature range of 150 to 180° C., the drying process time may be carried out in a time range of about 30 to 60 minutes. Conditions of the drying process may be adjusted according to physical or chemical properties of the paste.

In the drying process, micro patterns including the electromagnetic loss material may be formed on the base member. The paste patterned by the drying process may be thermally cured to improve adhesion to the base member and form micro patterns. In particular, when the patterned paste is thermally cured, the electromagnetic loss material contained in the paste may form strong bonds with each other by heat. That is, a conductivity of micro patterns may be increased through thermosetting of the patterned paste. In other words, since micro patterns formed through thermosetting has a high conductivity, high dielectric constant of the composite material can be expected.

Figure 2:
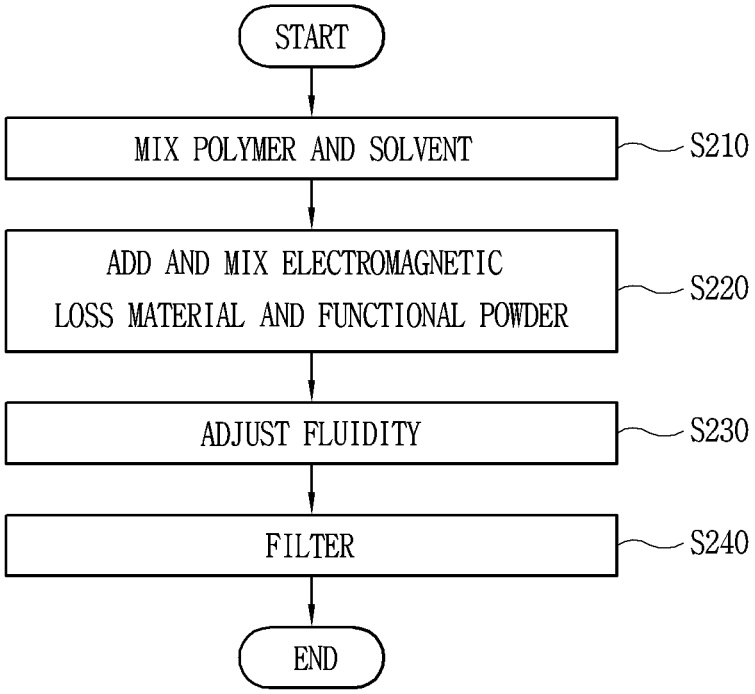
FIG. 2 is a flowchart illustrating a procedure of a method to fabricate a paste of a composite material through micro pattern printing of the present disclosure.

FIG. 2 is a flowchart illustrating a procedure of a method to fabricate a paste of a composite material through micro pattern printing of the present disclosure.

Referring to FIG. 2, the method to fabricate a paste of a composite material through micro pattern printing may include mixing a polymer and a solvent (S210), adding and mixing of an electromagnetic loss material and a functional powder (S220), adjusting fluidity (S230), and filtering (S240).

In mixing a polymer and a solvent (S210), the polymer may be thermally cured upon drying including a thermosetting polymer to form micro patterns. Furthermore, the solvent may be capable of scattering the polymer in a solution. In addition, the solution scattered in the solvent may be filtered to remove impurities of a solid.

In the adding and mixing of the electromagnetic loss material and the functional powder (S220), the electromagnetic loss material includes at least one of a dielectric body, a magnetic body, or a conductor body, and thus the paste may have conductivity. In addition, depending on the components of the functional powder to be added, electrical properties as well as magnetic properties of the paste may be imparted. In addition, in adding and mixing of the electromagnetic loss material and the functional powder (S220), mixing may be performed in various ways, and in one embodiment, the mixing can be performed by a roll-milling using a 3-roll-mill.

In adjusting fluidity (S230), an additive or a solvent may be added to have a fluidity suitable for forming a pattern on the base member.

Subsequently, solid impurities with a predetermined size or greater may be removed in filtering (S240). Thus, when the patterns are formed on the base member with a paste, the pattern may be formed to have uniformed electromagnetic loss properties.

Figure 3:
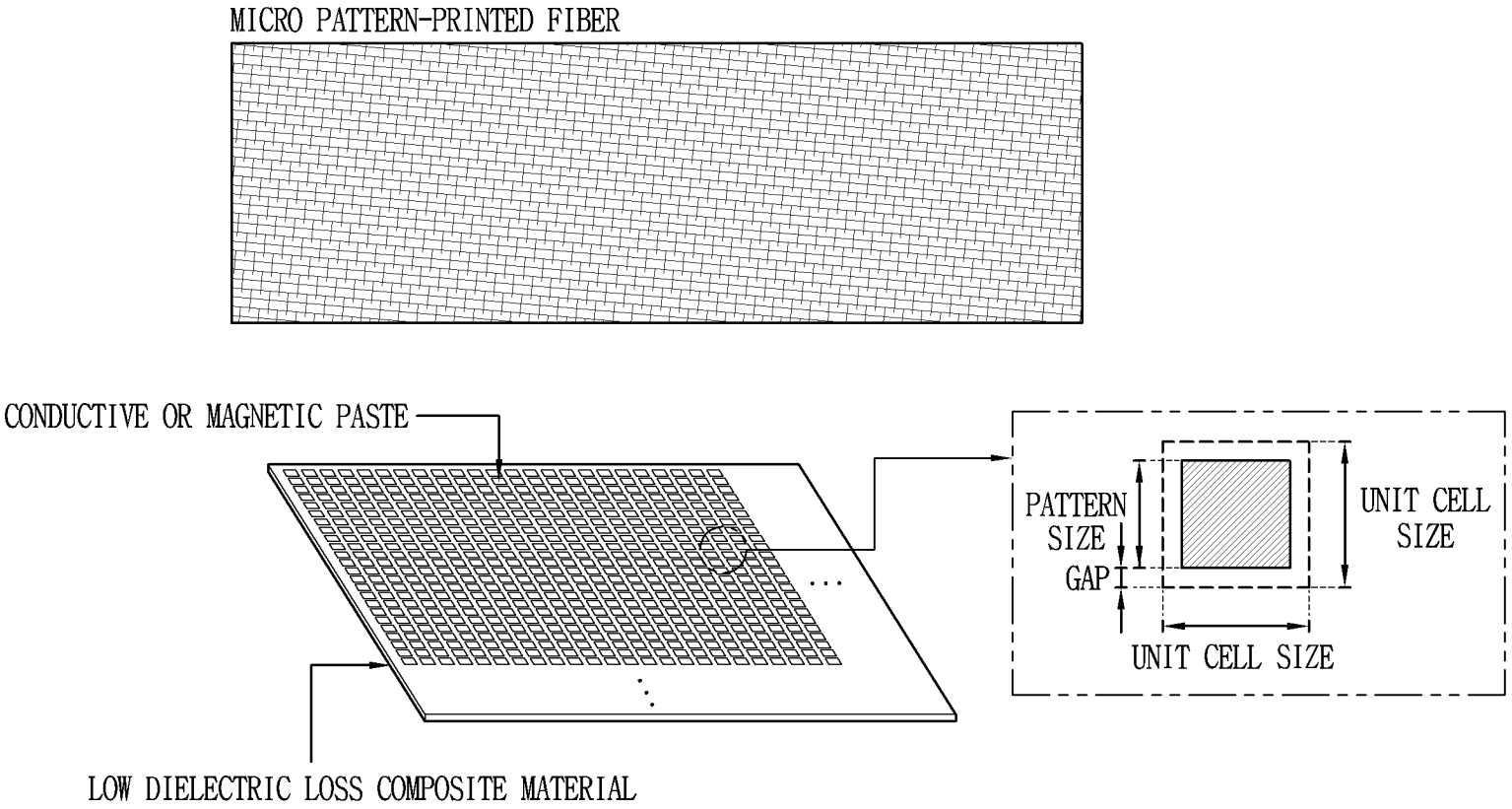
FIG. 3 is a conceptual view of a composite material sheet having micro patterns of the present disclosure.

FIG. 3 is a conceptual view of the composite material sheet having micro patterns of the present disclosure.

Referring to FIG. 3, a pattern designed in setting a dielectric constant value needed in composite material (S100), and a paste including the above-described electromagnetic loss material are printed on the base member 10 and dried or thermally treated, thereby forming micro patterns 20. As illustrated, micro patterns 20 may be formed as a pattern having a gap inside a predetermined unit cell. A spacing and a width of micro patterns 20 may be an important design factor to control the dielectric constant of the composite material, and in general, the electromagnetic properties may be adjusted according to the formation of the pattern by the paste. Further, although micro patterns 20 is illustrated as a rectangular pattern in one embodiment, micro patterns 20 may be designed in various forms by those skilled in the art. Therefore, there is an effect that the design freedom in setting the electromagnetic absorption frequency band and structural properties (strength/rigidity).

Furthermore, according to another embodiment of the present disclosure described below, the same or similar reference numerals are designated to the same or similar configurations to the foregoing example, and the description thereof will be substituted by the earlier description.

Figure 4:
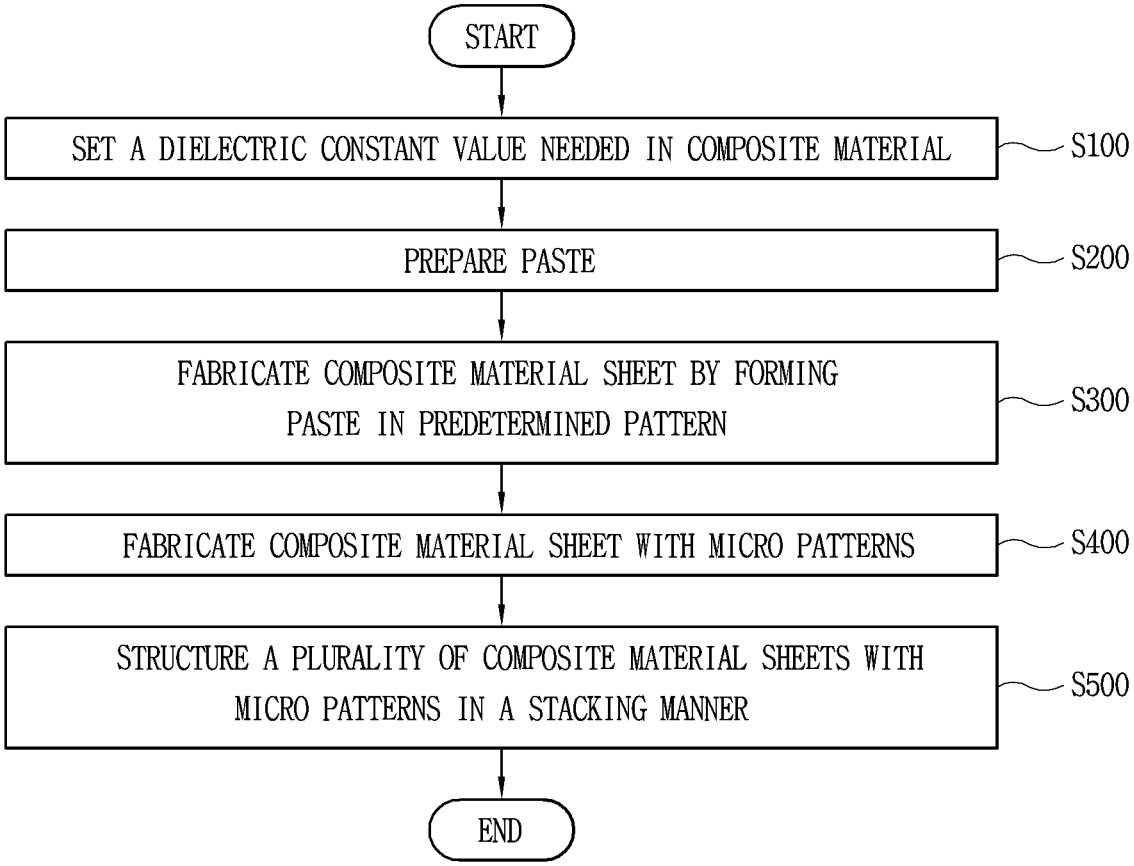
FIG. 4 is a flowchart illustrating a method for controlling dielectric constant of a composite material through micro pattern printing according to another embodiment of the present disclosure.
Figure 5:
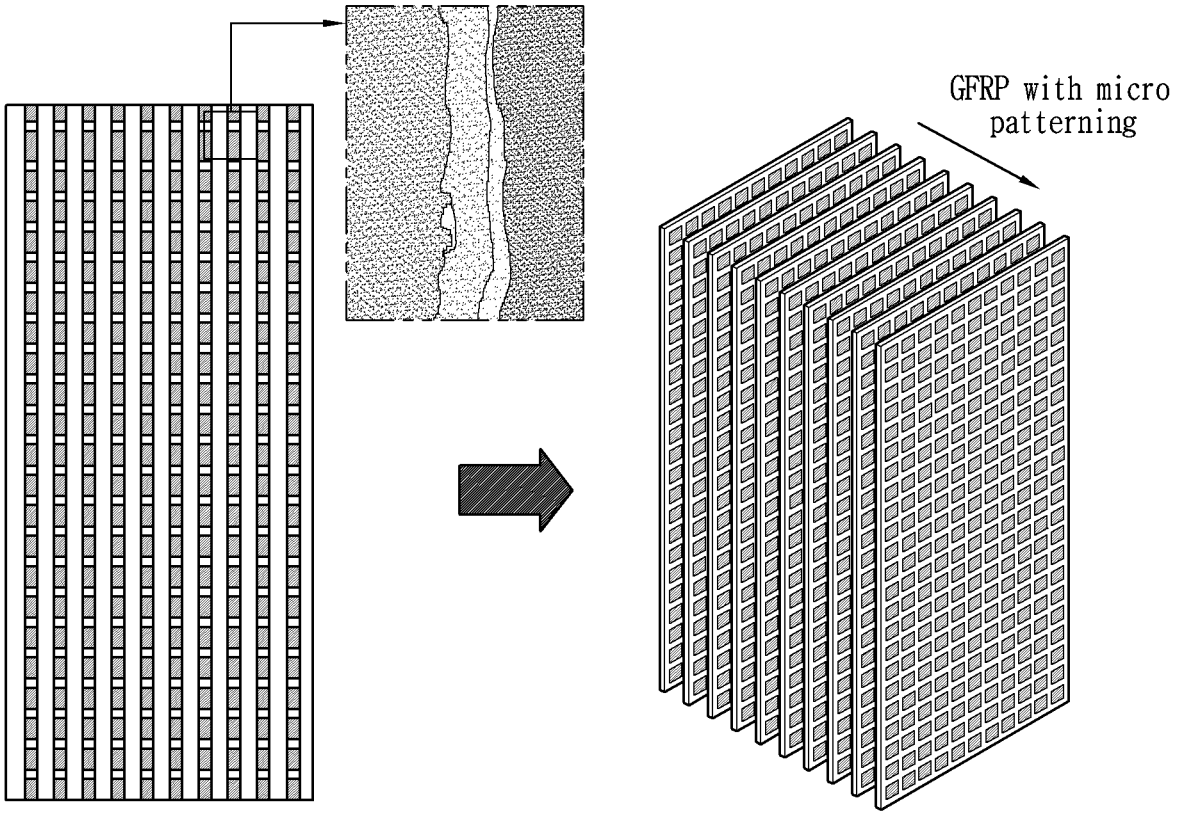
FIG. 5 is a conceptual view illustrating an embodiment according to the flowchart of FIG. 4.

FIG. 4 is a flowchart illustrating a method for controlling dielectric constant of a composite material through micro pattern printing according to another embodiment of the present disclosure, and FIG. 5 is a conceptual view illustrating the embodiment according to the flowchart of FIG. 4.

Referring to FIGS. 4 and 5, the aforementioned method for controlling dielectric constant of composite material by micro pattern printing may include setting a dielectric constant value needed in composite material (S100), preparing a paste having an electromagnetic loss material (S200), fabricating a composite material sheet by forming the paste on one surface of a base member in a predetermined pattern (S300), and drying the composite material sheet to fabricate a composite material sheet with micro patterns (S400). In addition, structuring a plurality of composite material sheets with micro patterns in a stacking manner (S500) may be further included.

A composite material having dielectric constant, magnetic permeability, or conductivity in accordance with design conditions can be fabricated only with the composite material sheet formed with a single micro pattern formed in fabricating the composite material sheet formed with micro patterns (S400). However, physical properties of the composite material can be controlled by structuring a plurality of composite material sheets with micro patterns in a stacking manner according to a use of the composite material. The physical properties may be properties such as thickness, strength/rigidity of the composite material.

As illustrated in FIG. 5, after structing the plurality of composite material sheets with micro patterns in the stacking manner, the printed micro patterns may exist between layers of the base members, respectively. An electromagnetic behavior of the composite material on which micro patterns are printed can be expressed by Equations 1 and 2 below.

$$\varepsilon=\varepsilon'-j\varepsilon'' \quad \text{[Equation 1]}$$

$$\mu=\mu'-j\mu'' \quad \text{[Equation 2]}$$

The dielectric constant ε and the magnetic permeability μ denote a ratio of intensities of an electromagnetic field when the electromagnetic field is applied to a medium compared to when the electromagnetic field is applied to air, and the value is determined according to a material. The dielectric constant ε and the magnetic permeability μ are usually expressed in a real part and an imaginary part in complex numbers. Thus, the electromagnetic behavior of the composite material sheet formed with micro patterns can be interpreted electromagnetically like a uniform medium having a specific dielectric constant and a magnetic permeability.

Furthermore, since the pattern printed on the structured composite material sheet is very small compared to the wavelength corresponding to the frequency of the corresponding electromagnetic wave, the pattern may behave like a material having a separate electromagnetic property by an effect of homogenization.

Figure 6:
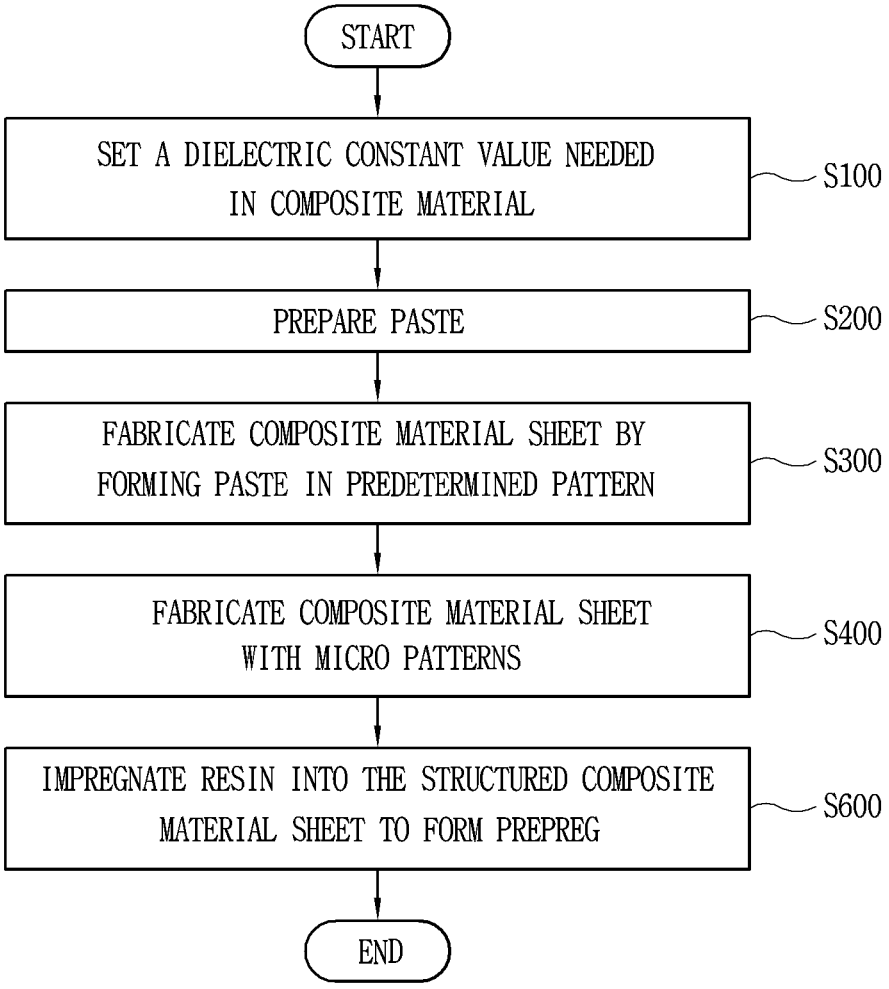
FIGS. 6 and 7 are conceptual views illustrating a procedure of a method for controlling dielectric constant of a composite material through micro pattern printing, which is another embodiment of the present disclosure.
Figure 7:
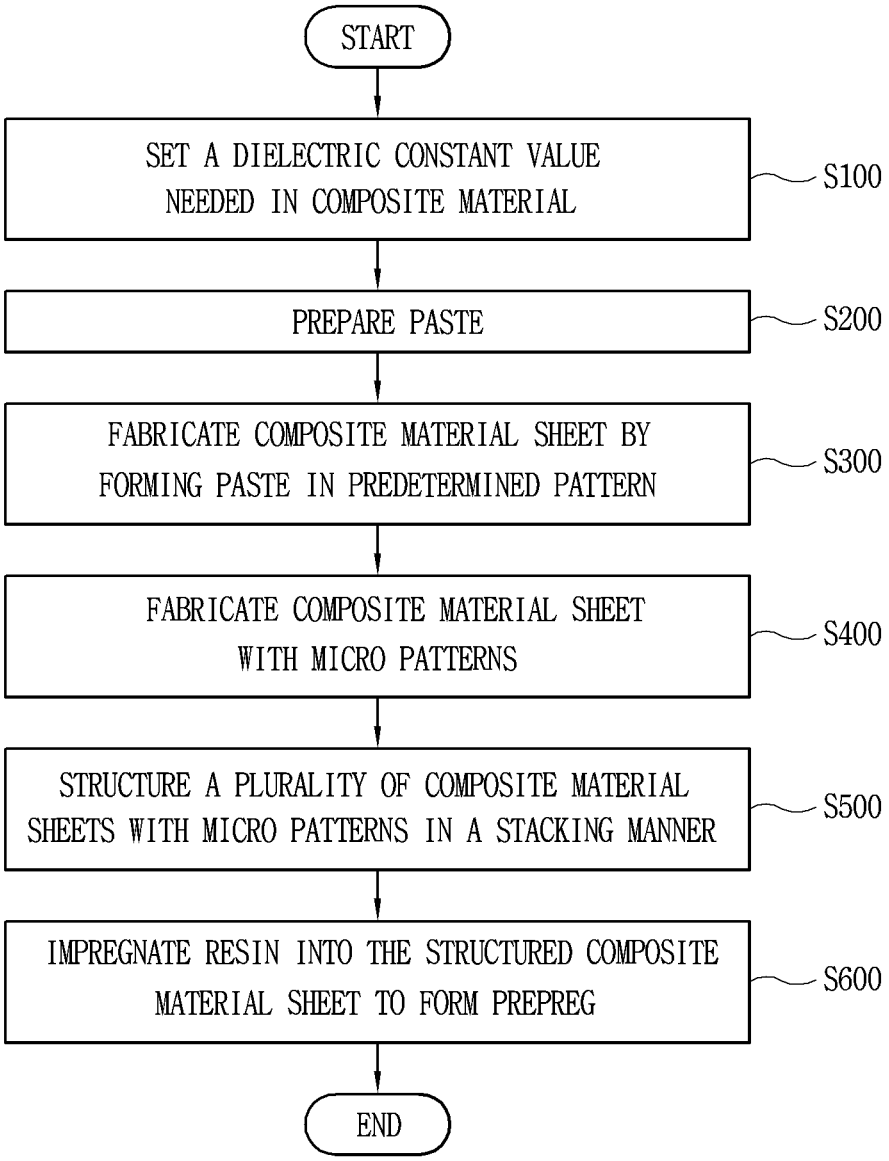

FIGS. 6 and 7 are conceptual views illustrating a procedure of a method for controlling dielectric constant of a composite material through micro pattern printing in accordance with still another embodiment of the present disclosure.

Referring to FIGS. 6 and 7, the method may further include forming a prepreg by impregnating the resin into the structured composite material sheet or the composite material sheet with the aforementioned micro patterns to form a prepreg (S600). The prepreg is an intermediate substrate for fiber-reinforced composite materials, and is a molding material in which reinforcing fibers are pre-impregnated with a matrix resin.

The prepreg is formed by impregnating the resin into the composite material sheet or the structured composite material sheet having micro patterns, so as to be easily fabricated by subsequently performing the existing composite material fabricating process. One embodiment that prepregization of the composite material sheet formed with micro patterns may be carried out in a pressure range of 3 to 6 bar in a temperature range of 110 to 140° C.

The prepreg may produce a structure by molding a multilayer at a high temperature or high pressure by laminating the multilayer in a film-like structural material in which a resin is mixed with a reinforcing fiber and semi-cured. For a resin mainly to form a prepreg, a thermosetting resin such as an epoxy resin is used.

Therefore, in order to perform the method for controlling dielectric constant of the composite material by forming a pattern with a paste containing an electromagnetic loss material on the prepreg, a paste including a UV curable polymer to prevent deformation of the prepreg during pattern formation was used in the related art.

However, the pattern formed of the paste containing the UV curable polymer has a disadvantage in that conductivity is lower than that of micro patterns formed of the paste containing the thermosetting polymer of the present disclosure, and the strength/rigidity of the prepreg is reduced by decomposition effect of the resin constituting the prepreg by the UV in UV-irradiation for curing of paste. In other words, since micro patterns formed by printing the paste including the thermosetting polymer of the present disclosure on the base member and by performing thermosetting has a high conductivity, a high dielectric constant of the composite material can be expected and the strength/rigidity is improved.

That is, compared to controlling dielectric constant by forming a pattern using the paste containing the UV curable polymer in the prepreg in the related art, high dielectric constant can be expected when the patterns are formed of the paste containing the electromagnetic loss material and the thermosetting polymer on one surface of the base member according to the present disclosure, and the resin is impregnated into the structured composite material sheet or the composite material sheet with the aforementioned micro patterns to form a prepreg (S600) after fabricating the composite material sheet having micro patterns by thermosetting the patterns.

Embodiments 1 to 4

In Embodiments 1 to 4, patterns of different sizes are formed by the paste including the electromagnetic loss material of the present disclosure on a fabric formed of glass fibers. The embodiments 1 to 4 were formed into rectangles having lengths of each one side thereof, 200 μm, 400 μm, 600 μm, and 800 μm, sequentially. In this case, although the sizes of the patterns in the embodiments 1 to 4 are different, an area of the pattern compared to an area of the unit cell is the same. In other words, assuming that a printed thickness of the paste is the same, the area of each pattern printed on the unit area may be the same.

Figure 8:
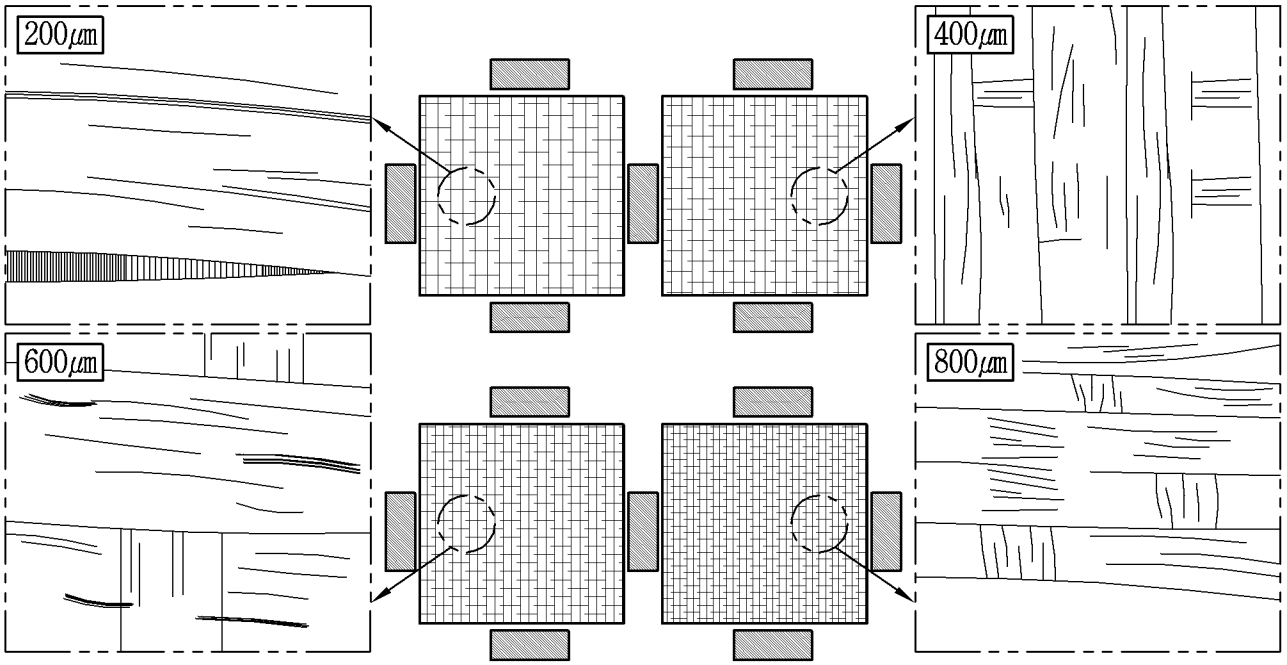
FIG. 8 is an SEM image of embodiments 1 to 4.

FIG. 8 is the SEM image of the embodiments 1 to 4. Referring to FIG. 8, it can be confirmed that designed patterns are printed on a bundle of glass fibers twisted into a specific shape.

Furthermore, the prepreg was formed by impregnating the resin into the composite material sheet having micro patterns of the embodiments 1 to 4, and specimens for electromagnetic performance evaluation were prepared by using the prepreg.

Figure 9:
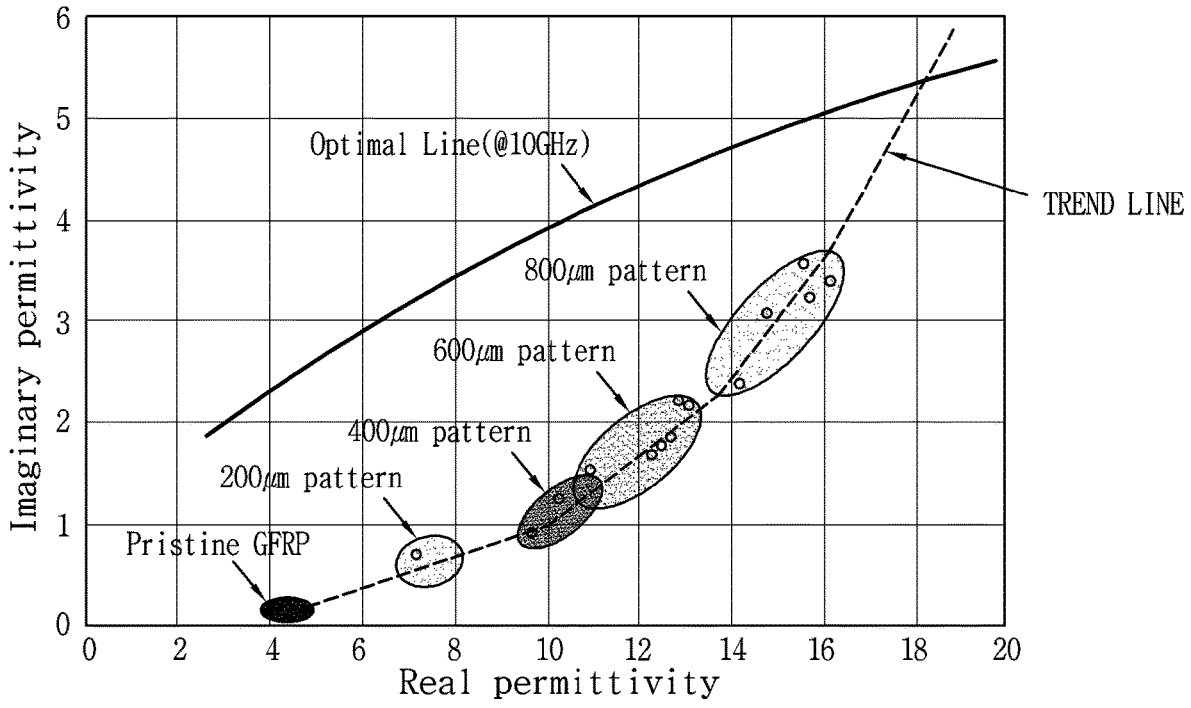
FIG. 9 is a graph illustrating a result of measuring dielectric constants of a prepreg by impregnating a resin into a composite material sheet having micro patterns of embodiments 1 to 4.

FIG. 9 is a graph illustrating the result of measuring dielectric constants of the prepreg by impregnating the resin into the composite material sheet having micro patterns of the embodiments 1 to 4.

Referring to FIG. 9, a solid line denotes an electromagnetic property diagram to fabricate an absorber as a single material by generating resonance at a frequency of 10 GHz. A horizontal axis of the graph denotes a real part of dielectric constant and a vertical axis denotes an imaginary part of dielectric constant.

In a case of unpattern glass fiber reinforced plastics (GFRP), a value of the real part is about 4 and a value of the imaginary part is about 0.1. On the other hand, in a case of a composite material using patterned glass fibers, it can be confirmed that the real part and the imaginary part of the dielectric constant increase as a size of the printed pattern increases.

Referring to a trend line in FIG. 9, there is a point that meets the solid line as the size of the pattern increases, a radar absorption design of a single material can be made with a property at this time. In addition, when electromagnetic properties of the paste used are increased or the printed area per unit area is large, it is also possible to upwardly shift the diagram of the trend line in FIG. 9.

Figure 10:
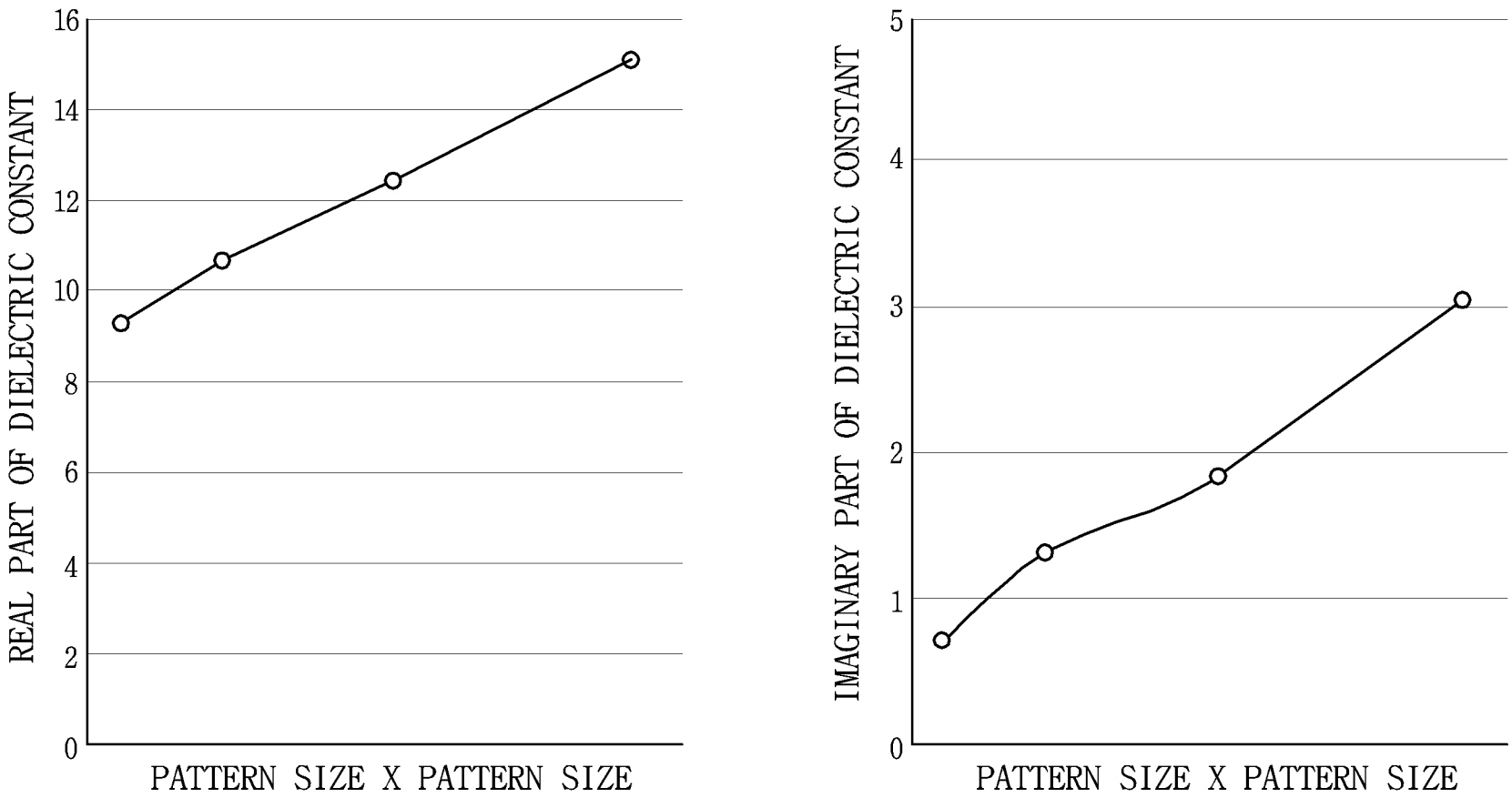
FIG. 10 is a graph illustrating a result of trend analysis of dielectric constants of a prepreg by impregnating resin into a composite material sheet having micro patterns of embodiments 1 to 4.

FIG. 10 is a graph illustrating the result of trend analysis of dielectric constants of the prepreg by impregnating resin into the composite material sheet having micro patterns of the embodiments 1 to 4.

Referring to FIG. 10, dielectric constants of the embodiments 1 to 4 are divided into a real part and an imaginary part to illustrate a graph. Both the real part and the imaginary part increase as the size of the printed pattern increases, and are increasing almost linearly with respect to the size of the pattern. This shows that the area of the pattern printed on the unit area is similar but the sizes of the patterns are different. This aspect is judged to be due to an effect of a wider electromagnetic polarization phenomenon in the pattern as the size of the pattern is changed.

That is, the above embodiments show a dielectric constant controlling technique according to the size of the printed pattern. Judging from the results illustrated in FIG. 10, when the area of the printed pattern is increased with respect to the unit area, it is judged that more rapid increasing of dielectric constant can be expected as the effect on the pattern and the total amount of the printed paste are increased.

Figure 11:
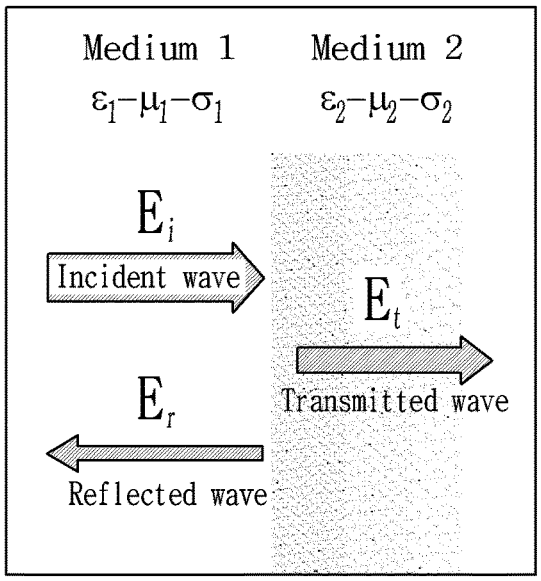
FIG. 11 is a conceptual view and equations indicating that transmission and reflection of incident electromagnetic waves are determined according to an electromagnetic property of a material.

FIG. 11 is a conceptual view and equations indicating that transmission and reflection of incident electromagnetic waves are determined according to an electromagnetic property of a material.

Referring to FIG. 11, the method for controlling dielectric constant of the composite material of the present disclosure can adjust ε value (permittivity) and μ value (permeability) of the medium, and is a technique to fabricate/supply a material that can satisfy desired transmission and reflection.

Figure 12:
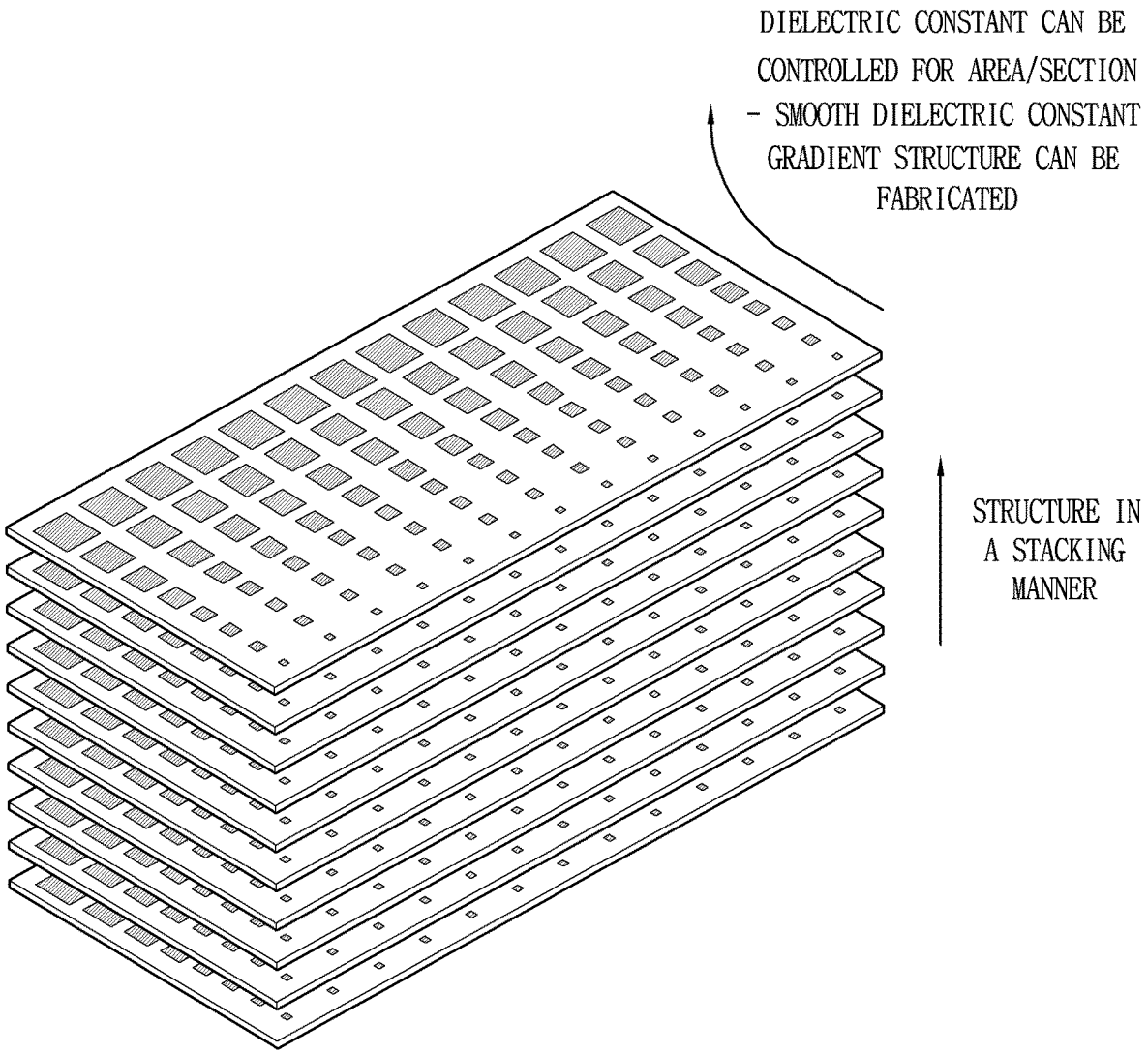
FIG. 12 is a conceptual view illustrating an embodiment of an application of micro pattern-printed composite material of the composite material of the present disclosure.
Figure 13:
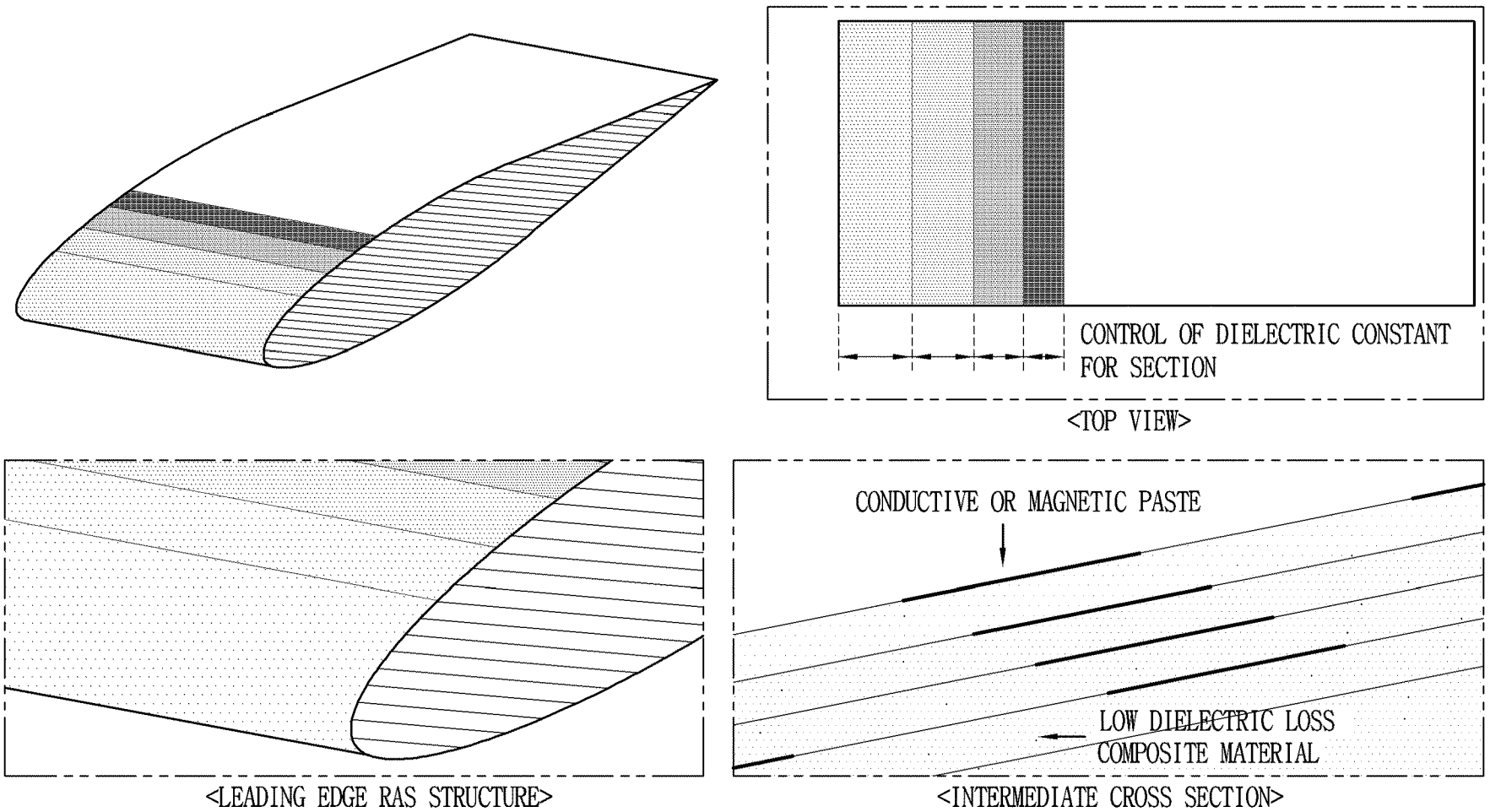
FIG. 13 is a conceptual view of a structure in which the application of FIG. 12 is applied.

FIG. 12 is a conceptual view illustrating the embodiment of the application of micro pattern-printed composite material of the composite material of the present disclosure, and FIG. 13 is a conceptual view of the structure in which the application of FIG. 12 is applied.

Referring to FIG. 12, a composite material using a pattern gradient may be fabricated by applying the method for controlling dielectric constant of the composite material of the present disclosure. In detail, rather than printing a same pattern on the base member, the pattern can be printed by adjusting the size of the pattern according to a needed design area. In this case, different electromagnetic properties can be implemented for each design area. The related art design concept has a disadvantage that different materials should be used in a design area of different electromagnetic properties. Accordingly, disadvantages such as an effect of electromagnetic scattering at different material interfaces and disconnection of a structural load transfer path have been presented.

However, when a composite material using the pattern gradient is fabricated by applying the method for controlling dielectric constant of the composite material of the present disclosure, the patterns are connected smoothly, and since the base material is the same, an effect of electromagnetic scattering can be suppressed during a transition of an electromagnetic area. In addition, since the composite material shares a fiber which is a main load transmission path, it is structurally advantageous even when fabricated as one part. Therefore, it is advantageous that an integral laminate structure with different dielectric constant for each laminate area/section can be fabricated.

Referring to FIG. 13, the application in FIG. 12 may be applied to stack the micro pattern-printed prepreg into multiple layers, thereby modeling a wing-shaped leading edge RAS structure. As described above, micro pattern-printed composite material is formed in a stacked structure, and the printed pattern layer is present between the layers of each composite material.

That is, in the example as illustrated in FIG. 1, it is confirmed that the gradient is applied by adjusting the size of the pattern for each section along a portion where a curvature of the structure is formed. This is one of the methods for the radar absorbing structure fabricated in a specific shape to realize a performance of a low probability of intercept optimized for a detection avoidance zone. In addition, since different dielectric materials can be implemented on a same base material (printed layer-low dielectric loss composite material) which may ensure a structural continuity, and thus, a structural reliability of a multi-functional structure can be secured.

Figure 14:
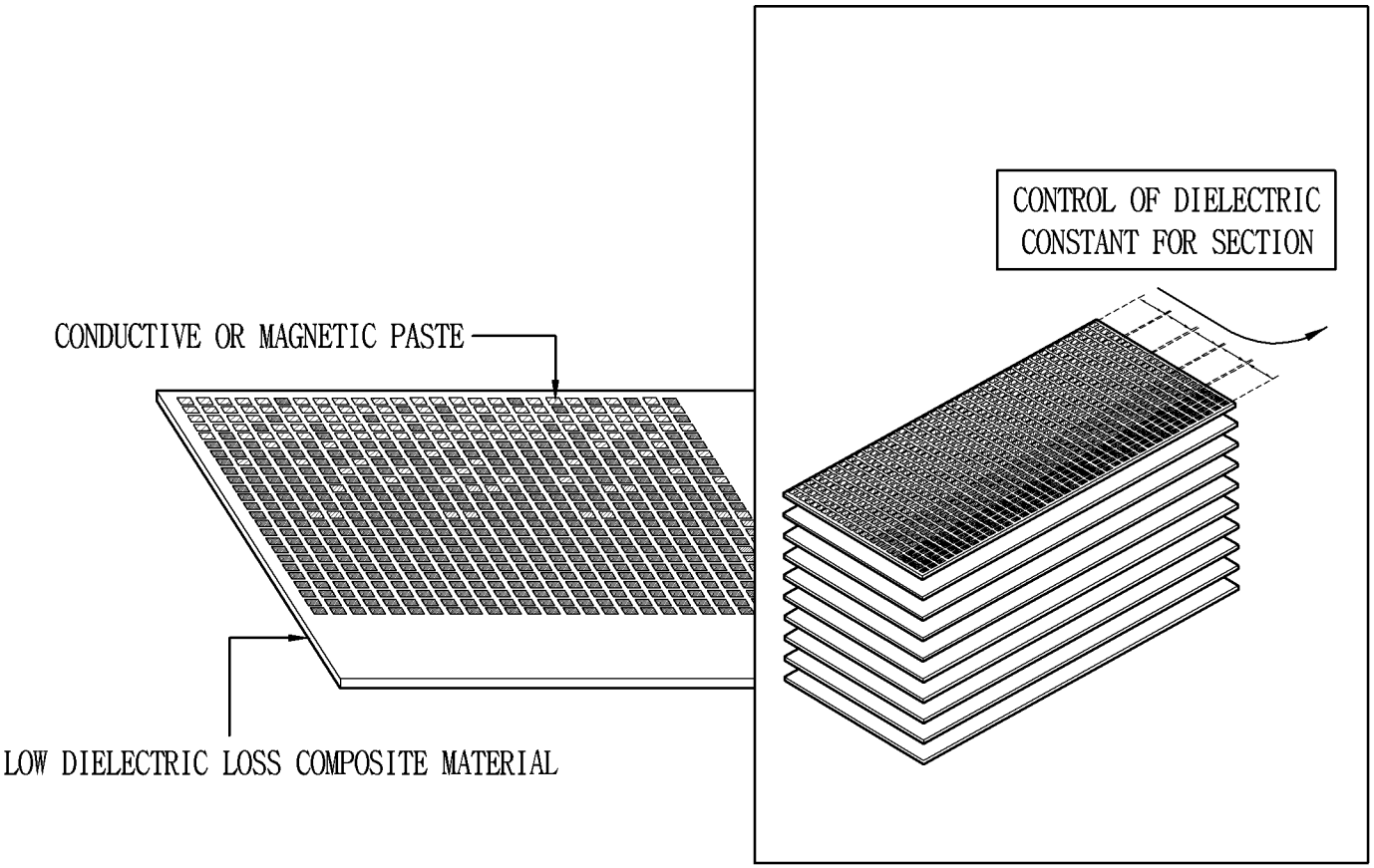
FIG. 14 is a conceptual view illustrating another embodiment of an application of micro pattern-printed composite material of the composite material of the present disclosure.

FIG. 14 is a conceptual view illustrating another embodiment of the application of micro pattern-printed composite material of the composite material of the present disclosure.

Referring to FIG. 14, micro patterns formed on the base member may implement a composite material by printing pastes having different electromagnetic properties on a same pattern plate. In other words, micro patterns formed on the base member may be formed of one or more pastes. Thus, similar to the one embodiment of the application of micro pattern-printed composite material of the composite material, a material having different electromagnetic properties for each area can be implemented, and electromagnetic or structural advantages can be highlighted.

The present disclosure can improve the design freedom by forming a predetermined pattern designed with the dielectric constant value needed for the composite material on one surface of the base member to control dielectric constant of the composite material.

In addition, since the micro patterns are formed by adding and mixing thermosetting polymers in the paste including the electromagnetic loss material and applying heat on the base member, the electromagnetic loss materials included in the paste may form strong bonds with each other by the heat. That is, since the conductivity of the micro pattern formed by thermosetting is increased, a high dielectric constant of the composite material can be expected.

In addition, the prepreg is formed by forming micro patterns including the electromagnetic loss material on the base member and impregnating a resin, so as to be commercialize by subsequently performing the existing composite material fabricating process. This may allow exclusion of separate surface treatment/chemical treatment on the composite material, thereby improving the structural rigidity/strength.

On the other hand, those skilled in the art to which the present disclosure belongs will be able to various modifications and variations without departing from the essential properties of the present disclosure. Therefore, the above detailed description should not be limitedly construed and should be considered illustrative in all aspects. The scope of the present disclosure should be determined by rational interpretation of the appended claims, and all changes within the scope of equivalents of the present disclosure are included in the scope of the present disclosure.

What is claimed is:

1. A method for controlling dielectric constant of a composite material through micro pattern printing, the method comprising:

setting a dielectric constant value needed in the composite material;

preparing a paste having an electromagnetic loss material;

preparing a base sheet having fibers;

forming the paste on one surface of the base sheet in a predetermined pattern to form a paste printed sheet; and drying the paste printed sheet to fabricate a composite material sheet with micro patterns including the electromagnetic loss material on the base sheet.

2. The method for claim 1, wherein the electromagnetic loss material comprises at least one of a dielectric body, a magnetic body, or a conductor body.

3. The method for claim 1, wherein the paste is provided with thermosetting polymers and is formed into the micro patterns by being thermally cured during the drying.

4. The method for claim 1, wherein the base sheet is made of at least one of glass, aramid, ceramic fiber or foam core.

5. The method for claim 4, wherein the base sheet is a fabric.

6. The method for claim 1, wherein a physical property is controlled by structuring a plurality of the composite material sheets with micro patterns in a stacking manner.

7. The method for claim 6, wherein a material to control dielectric constant is further included between the composite material sheets with micro patterns.

8. The method for claim 6, further comprising forming a prepreg by impregnating a resin into the structured composite material sheet.

9. The method for claim 1, further comprising forming a prepreg by impregnating the resin into the composite material sheet with the micro patterns.

10. The method for claim 1, wherein the predetermined pattern formed of the paste on the one surface of the base sheet has a pattern gradient due to a different size of the pattern for each section of the base sheet.

11. The method for claim 1, wherein the predetermined pattern formed of the paste on the one surface of the base sheet is formed of at least one type of paste.

12. The method for claim 1, wherein the drying of the paste printed sheet is carried out for 30 to 60 minutes in a temperature range of 150 to 180 ° C. to fabricate the composite material sheet with micro patterns.

13. A dielectric constant-controlled composite material comprising a composite material sheet with micro patterns fabricated by the method for controlling the dielectric constant of the composite material of claim 1.

* * * * *